United States Patent [19]

Clemens

[11] Patent Number: 4,683,959

[45] Date of Patent: Aug. 4, 1987

[54] BLADE GUIDE SYSTEM FOR GRADING VEHICLE WITH DISPLACEABLE GRADING BLADE

[75] Inventor: Karl-Heinz Clemens, Dortmund, Fed. Rep. of Germany

[73] Assignee: O&K Orenstein & Koppel Aktiengesellschaft, Berlin, Fed. Rep. of Germany

[21] Appl. No.: 767,533

[22] Filed: Aug. 20, 1985

[30] Foreign Application Priority Data

Sep. 28, 1984 [DE] Fed. Rep. of Germany ..... 3435703

[51] Int. Cl.[4] ..... E02F 3/76

[52] U.S. Cl. ..... 172/795; 172/667; 172/705; 384/40

[58] Field of Search ..... 172/673, 815, 795, 794, 172/701.1, 667, 741, 705, 781; 308/3 R

[56] References Cited

U.S. PATENT DOCUMENTS

| | | | |
|---|---|---|---|
| 2,009,421 | 7/1935 | Walz | 308/3 R |
| 3,184,860 | 5/1965 | Garrison | 308/3 R X |
| 3,463,243 | 8/1969 | Fisher | 308/3 R X |
| 3,465,829 | 9/1969 | Fisher | 172/795 |
| 4,037,670 | 7/1977 | Atherton | 172/673 |
| 4,084,643 | 4/1978 | Easterling | 172/795 |

*Primary Examiner*—Richard J. Johnson
*Attorney, Agent, or Firm*—Martin A. Farber

[57] ABSTRACT

The grading vehicle has a grading blade which is guided displaceably on the frame of the vehicle transverse to the longitudinal direction of the vehicle. In order to obtain automatic readjustment of the guidance of the blade upon the occurrence of wear and play in the guidance, the blade is displaceable, by means of two guide ledges which extend horizontally on the blade and are spaced vertically from each other, between upper and lower slide pieces, the lower slide pieces being movable vertically and being pushed by spring force against the lower guide ledge of the blade.

2 Claims, 2 Drawing Figures

BLADE GUIDE SYSTEM FOR GRADING VEHICLE WITH DISPLACEABLE GRADING BLADE

FIELD AND BACKGROUND OF THE INVENTION

The present invention relates to a grading vehicle having a grading blade which is displaceably guided on the frame of the vehicle transverse to the longitudinal direction of the vehicle.

For the displacement, distributing and leveling of earth or the like, use is made of work vehicles known as graders whose grading blade, which is arranged between the axles of the vehicle, is displaced hydraulically in slideways also transverse to the direction of travel or longitudinal direction of the vehicle. The forces which prevail during the transverse displacements of the blade as a result of the vertical pressure of the blade down on the ground or else by the advancing of the blade against the ground result in wear to the slideways, which leads to increasing play in the slideways. As a result of this play, there is the possibility of the canting of the blade as well as sudden changes of load in the slideways. The wear and play therefore make readjustment of the slideways necessary. For this purpose, the slideways customary up to the present time had to be frequently serviced and readjusted at regular intervals, for instance by means of readjustment screws in different planes.

SUMMARY OF THE INVENTION

It is an object of the invention to avoid the regular readjustment in order to compensate for wear and play which is necessary in the ordinary blade slideways so that the maintenance work can be reduced, that there is no longer any possibility of the blade canting because the guidance of the blade has not been readjusted, and that blows in the blade guide which increase with play are done away with.

According to the invention, there is provided a grading vehicle of the aforementioned type in which the blade (2), by means of two horizontally extending guide ledges (3, 4) which are spaced vertically from each other, is displaceable between upper and lower slide pieces (6, 7) on the frame of the vehicle, the lower slide pieces (7) being pressed by spring force (9) against the lower guide ledge (4) of the blade.

In this way, upon the occurrence of wear on the slide pieces or on the guide ledges, automatic readjustment of the guidance of the blade to the desired play-free condition is effected. Furthermore, in the event of a non-parallel course of the guide ledges or in case of unevenness of the guide ledges, an automatic equalization of distance between the upper and lower slide pieces takes place so that the blade remains slidingly guided without play over its transverse path of displacement. The provision of springs on the lower slide pieces which can be pushed upward and press the blade against the fixed upper slide pieces has the great advantage that the springs need merely overcome the weight of the blade and, as a result, small spring forces are sufficient to keep the guidance of the blade at all times free of play. If the springs were provided on the upper slide pieces they would have to overcome the upward directed blade pressing forces and spring forces several times greater would be necessary for this, which forces in their turn would hold the guidance of the blade so tight, causing high sliding friction in the guidance of the blade, that a considerably larger and stronger hydraulic cylinder would have to be provided in order to be able to effect the transverse displacement of the blade.

DETAILED DESCRIPTION OF THE PREFERRED EMBODIMENT

Figure 1:
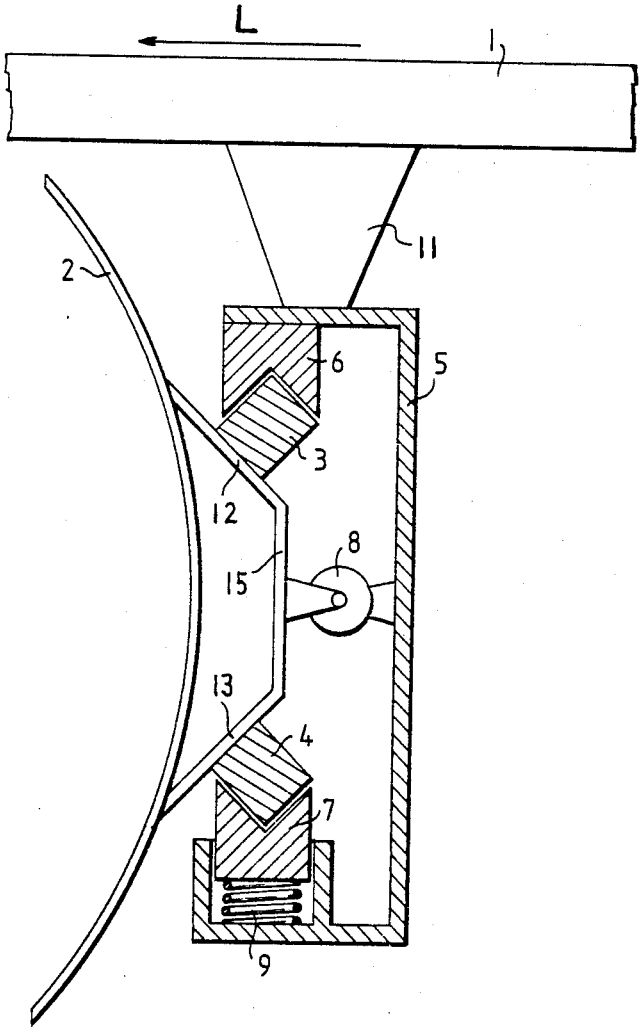
FIG. 1 is a vertical cross-sectional view showing diagrammatically one embodiment of the guidance of the blade in accordance with the invention as detail of a grading vehicle or grader, not otherwise shown.
Figure 2:
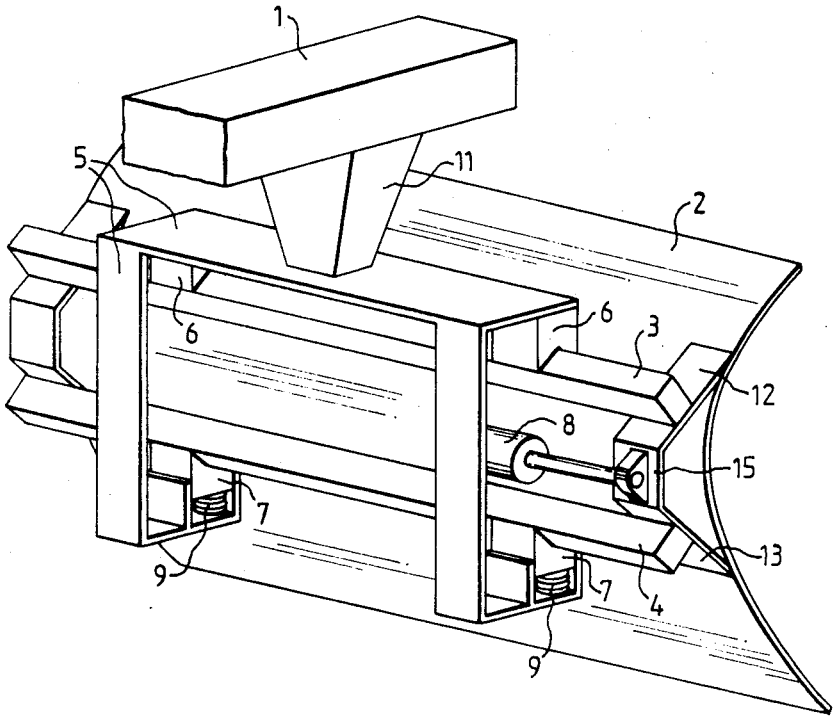
FIG. 2 is a perspective view of the blade guide system of the invention.

The blade 2, which is displaceable and directed transverse to the longitudinal direction or direction L of travel of the vehicle frame 1, is provided on its rear with two, for instance, prismatic guide ledges 3 and 4 which extend horizontally in the longitudinal direction of the blade and are spaced vertically from each other. A blade guidance frame 5 is supported by the vehicle frame 1, for instance with the imposition of customary means 11 by which the frame 5 and the blade can be adjusted in height or tilted around a horizontal axis or swung around a vertical axis. On the frame 5 there are arranged upper slide pieces 6 and lower slide pieces 7, which are developed in a manner adapted to the two guide ledges 3 and 4, for instance in each case two slide pieces spaced apart from each other in the longitudinal direction of the upper and lower guide ledges respectively. These upper and lower slide pieces receive the guide ledges of the blade without play and in horizontally displaceable manner between them. For the displacement of the blade 2 with respect to the frame 5 a hydraulic cylinder 8 is provided which acts on the blade and on the frame. The lower slide pieces 7 are movable in vertical direction on the frame 5 and are under the action of springs 9 which, with a spring force which overcomes the weight of the blade 2, press the lower slide pieces 7 upwardly against the lower guide ledge 4 and thus the upper guide ledge 3 against the upper slide pieces 6 which are arranged rigidly on the frame 5. In this way, the blade guide is always held together free of play, and wear of the slide pieces or of the guide ledges is automatically adjusted for. Similarly, upon the transverse displacement of the blade 2, for instance in the event that the guide ledges 3 and 4 are not completely parallel, there is automatic compensation of the vertical spacing between the upper and lower slide pieces 6 and 7 respectively.

The blade 2 is convex with respect to a rear side thereof. The rear portion of the blade forms a stay having two substantially symmetrically oppositely inclined portions 12, 13 and a vertical portion 15 connected therebetween, the inclined portions are connected to a central convex portion of the blade 2 at its rear, and the ledges 3, 4 are connected to the inclined portions 12, 13, respectively.

The ledges 3, 4 have a rectangular cross-section and are connected on one side of the rectangular cross-section to the inclined portions 12, 13, respectively.

The blade guide further includes the blade guidance frame 5 which is fixed to the two upper slide pieces 6. The two lower slide pieces 7 are vertically displaceably mounted in the guidance frame 5 via the spring 9. The slide pieces 6 and 7 are formed with V-shaped ends complementary to the portions of the ledges 3, 4 which displace thereon.

While I have disclosed one embodiment of the invention, it is to be understood that this embodiment is given by example only and not in a limiting sense.

I claim:

1. In a grading vehicle having a grading blade, the grading blade being operatively displaceably guided transversely to the longitudinal direction of the vehicle on a frame of the vehicle in a blade guidance frame, the improvement comprising two substantially horizontally extending guide ledges which are spaced vertically from each other and are mounted on the blade, upper and lower slide pieces confining said ledges against longitudinal movement, said ledges being displaceable between said upper and lower slide pieces transversely to the longitudinal direction of the vehicle, said upper slide pieces being rigidly disposed on said blade guidance frame, and spring means disposed between said blade guidance frame and said lower slide pieces for pressing said lower slide pieces upwardly against the lower of said guide ledges and pressing the upper of said guide ledges upwardly against said upper slide pieces and said spring means constituting the sole support for the weight of said blade.

2. The system according to claim 1, wherein said spring means is sized so as to substantially merely overcome the weight of said blade.

* * * * *